US010133234B2

(12) United States Patent
Yokoi

(10) Patent No.: US 10,133,234 B2
(45) **Date of Patent: *Nov. 20, 2018**

(54) PROCESS CARTRIDGE PROVIDED WITH CONTACT PORTION FOR APPLYING VOLTAGE TO DEVELOPING ROLLER

(71) Applicant: Brother Kogyo Kabushiki Kaisha, Nagoya-shi, Aichi-ken (JP)

(72) Inventor: Junichi Yokoi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/886,066

(22) Filed: Feb. 1, 2018

(65) Prior Publication Data

US 2018/0157210 A1 Jun. 7, 2018

Related U.S. Application Data

(63) Continuation of application No. 15/444,437, filed on Feb. 28, 2017, now Pat. No. 9,910,404.

(30) Foreign Application Priority Data

Mar. 15, 2016 (JP) ..... 2016-050494

(51) Int. Cl.

| | |
|---|---|
| ***G03G 15/00*** | (2006.01) |
| ***G03G 15/08*** | (2006.01) |
| ***G03G 21/18*** | (2006.01) |

(52) U.S. Cl.

CPC ..... *G03G 21/1814* (2013.01); *G03G 21/1825* (2013.01); *G03G 21/1821* (2013.01)

(58) Field of Classification Search

CPC ..... G03G 21/1814; G03G 21/1825; G03G 21/1821

(Continued)

(56) References Cited

U.S. PATENT DOCUMENTS 5,119,137 A 6/1992 Katagata
8,862,015 B2 * 10/2014 Koishi ..... G03G 21/1871 399/111

(Continued)

FOREIGN PATENT DOCUMENTS

JP 2013-134299 A 7/2013

*Primary Examiner* — Susan Lee

(74) *Attorney, Agent, or Firm* — Banner & Witcoff, Ltd.

(57) ABSTRACT

A process cartridge includes: a developing unit; a drum unit; an urging member; and an electrically-conductive member. The developing unit includes a developing roller. The drum unit includes a photosensitive drum. The developing unit is pivotally movable relative to the drum unit about a pivot axis extending along the developing roller. The urging member is configured to urge the developing roller toward the photosensitive drum. The electrically-conductive member is provided at the developing unit and configured to apply voltage to the developing roller. The electrically-conductive member is made of an electrically-conductive resin. The electrically-conductive member includes a contact portion configured to contact an electric contact provided at an image forming apparatus. The pivot axis and the contact portion define a first distance therebetween. The pivot axis and the urging member define a second distance therebetween. The first distance is smaller than the second distance.

18 Claims, 6 Drawing Sheets

(58) Field of Classification Search
USPC ..... 399/90, 119, 113
See application file for complete search history.

(56) References Cited

U.S. PATENT DOCUMENTS

| | | | | |
|---|---|---|---|---|
| 9,213,306 | B2 | 12/2015 | Morioka et al. | |
| 9,910,404 | B2 * | 3/2018 | Yokoi ..... | G03G 21/1814 |
| 2013/0164029 | A1 | 6/2013 | Fukui et al. | |
| 2015/0055978 | A1 | 2/2015 | Izumi et al. | |

* cited by examiner

PROCESS CARTRIDGE PROVIDED WITH CONTACT PORTION FOR APPLYING VOLTAGE TO DEVELOPING ROLLER

CROSS REFERENCE TO RELATED APPLICATION

This application is a continuation of U.S. patent application Ser. No. 15/444,437 filed Feb. 28, 2017 which claims priority from Japanese Patent Application No. 2016-050494 filed Mar. 15, 2016. The entire content of the priority applications are incorporated herein by reference.

TECHNICAL FIELD

The present disclosure relates to a process cartridge including: a developing unit provided with a developing roller; and a drum unit provided with a photosensitive drum.

BACKGROUND

There has been conventionally known a process cartridge including a developing unit and a drum unit. The developing unit is attached to the drum unit so as to be pivotally movable relative to the drum unit about a prescribed pivot axis. One such process cartridge is disclosed in Japanese patent application publication No. 2013-134299. In this process cartridge, a developing roller provided at the developing unit can separate from and contact a photosensitive drum provided at the drum unit in accordance with a pivotal movement of the developing unit relative to the drum unit.

In this type of process cartridge, an electrically-conductive member is provided for applying voltage to the developing roller. A part of the electrically-conductive member is exposed to an outside. The exposed part of the electrically-conductive member serves as a developing electrode. An electrode provided in a main casing of an image forming apparatus is brought into contact with the exposed part. Such configuration has been used in actual products. Further, in this configuration, a spring is disposed between the developing electrode and a pivot axis of the developing unit for urging the developing roller toward the photosensitive drum.

SUMMARY

However, in the above described configuration, the developing electrode is disposed at a position farther away from the pivot axis of the developing unit than the spring from the pivot axis of the developing unit. To prevent the developing electrode from displacing from the electrode of the main casing when the developing unit is pivotally moved between a contact position and a separation position, the developing electrode is required to increase its size in the moving direction of the developing unit. Due to increase in size of the developing electrode, the process cartridge also grows in size.

In view of the foregoing, it is an object of the disclosure to provide a process cartridge in which a developing unit is attached to a drum unit so as to be pivotally movable relative to the drum unit about a prescribed pivot axis, the process cartridge provided with a downsized developing electrode (contact portion).

In order to attain the above and other objects, the disclosure provides a process cartridge including: a developing unit; a drum unit; an urging member; and an electrically-conductive member. The developing unit includes a developing roller. The drum unit includes a photosensitive drum.

The developing unit is mounted to the drum unit so as to be pivotally movable relative to the drum unit about a pivot axis extending along the developing roller. The urging member is configured to urge the developing roller toward the photosensitive drum. The electrically-conductive member is provided at the developing unit and configured to apply voltage to the developing roller. The electrically-conductive member is made of an electrically-conductive resin. The electrically-conductive member includes a contact portion configured to contact an electric contact provided at an image forming apparatus. The pivot axis and the contact portion define a first distance therebetween. The pivot axis and the urging member define a second distance therebetween. The first distance is smaller than the second distance.

BRIEF DESCRIPTION OF THE DRAWINGS

The particular features and advantages of the embodiment(s) as well as other objects will become apparent from the following description taken in connection with the accompanying drawings, in which.

DETAILED DESCRIPTION

Figure 1:
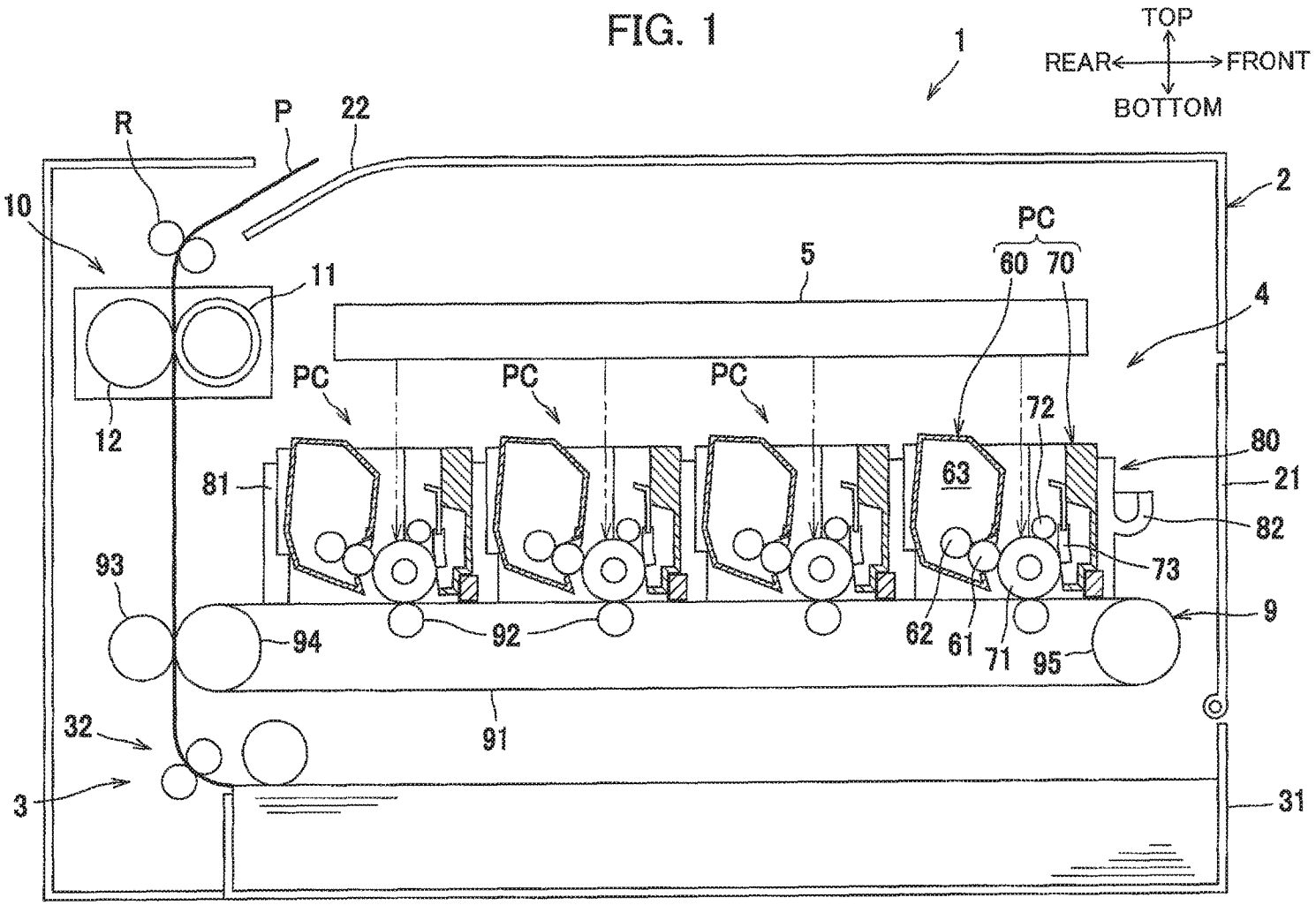
FIG. 1 is a schematic cross-sectional view of a color printer provided with a plurality of process cartridges according to one embodiment.

A color printer 1 as an example of an image forming apparatus according to one embodiment will be described with reference to the accompanying drawings, wherein like parts and components are designated by the same reference numerals to avoid duplicating description.

In the following description, directions related to the color printer 1 will be defined based on the perspective of a user using the color printer 1. More specifically, a right side in FIG. 1 will be referred to as a front side of the color printer 1, while a left side in FIG. 1 will be referred to as a rear side of the color printer 1. Further, a near side in FIG. 1 will be referred to as a left side of the color printer 1, while a far side in FIG. 1 will be referred to as a right side of the color printer 1. Further, a top side in FIG. 1 will be referred to as a top side of the color printer 1, while a bottom side in FIG. 1 will be referred to as a bottom side of the color printer 1. A top-bottom direction in FIG. 1 will be referred to as a vertical direction.

As illustrated in FIG. 1, the color printer 1 includes a main casing 2, a sheet supply unit 3 for supplying sheets of paper P, and an image forming unit 4 for forming images on the sheets P supplied from the sheet supply unit 3.

Figure 2:
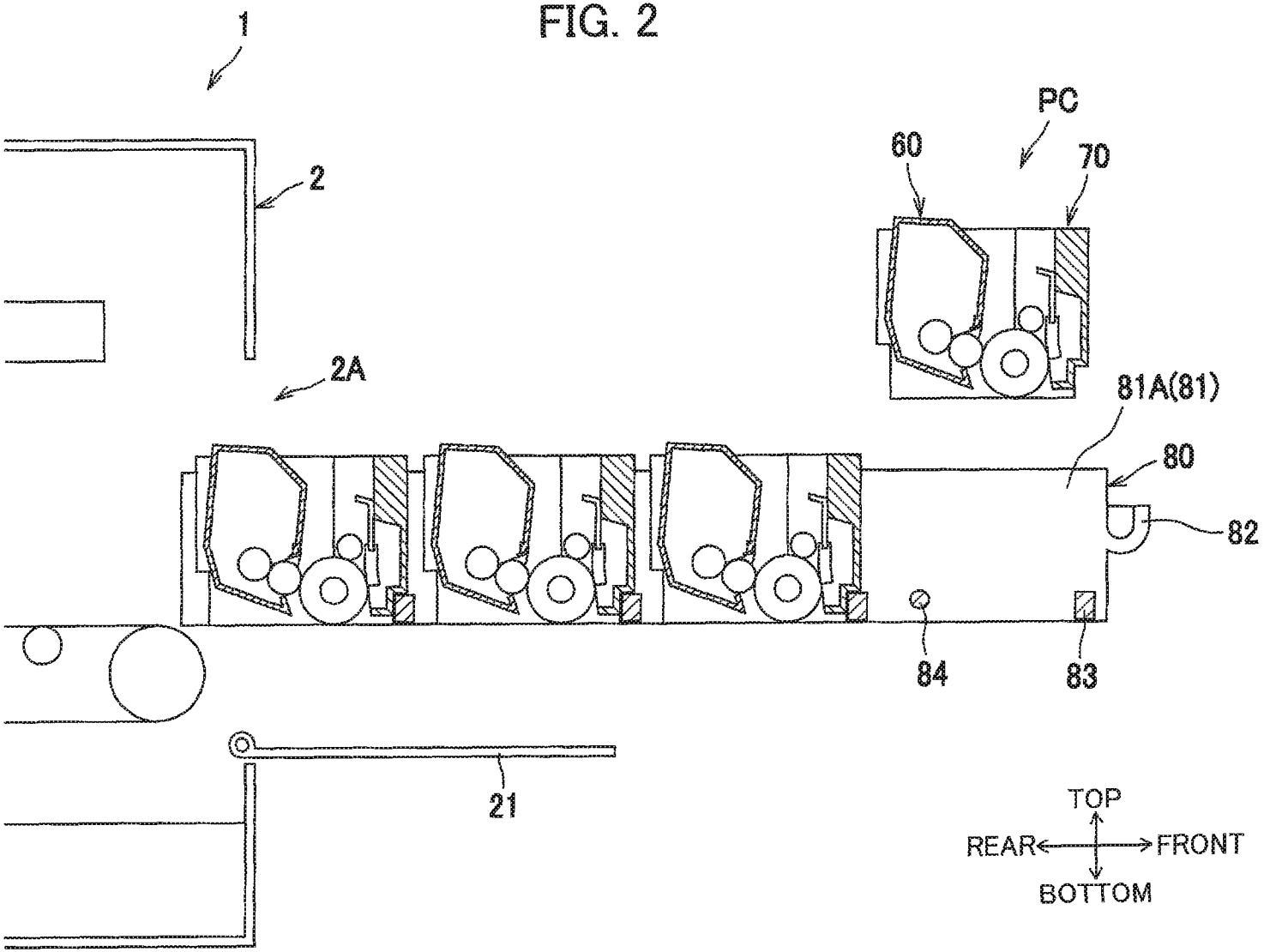
FIG. 2 is a schematic partial cross-sectional view of the color printer, illustrating a state where a drawer is withdrawn from a main casing of the color printer.

The main casing 2 has an opening 2A formed on a front side thereof (FIG. 2). The main casing 2 includes a front cover 21 for covering and exposing the opening 2A.

The sheet supply unit 3 is disposed in the main casing 2 at a lower portion thereof. The sheet supply unit 3 includes a sheet tray 31 and a sheet supply mechanism 32. The sheet supply mechanism 32 is configured to supply the sheets P accommodated in the sheet tray 31 to the image forming unit 4.

The image forming unit 4 includes a scanning unit 5, a plurality of (four in the embodiment) process cartridges PC, a belt unit 9, and a fixing device 10.

The scanning unit 5 is disposed at an upper portion of the main casing 2. The scanning unit 5 includes a laser emitting portion (not illustrated), a polygon mirror (not illustrated), lenses (not illustrated), and reflecting mirrors (not illustrated). The scanning unit 5 is configured to irradiate photosensitive drums 71 with laser beams such that surfaces of the photosensitive drums 71 are subjected to scan of the laser beams.

The four process cartridges PC are disposed below the scanning unit 5. The four process cartridges PC are disposed in a drawer 80 and juxtaposed with each other in a front-rear direction.

Each of the four process cartridges PC includes a developing unit 60 and a drum unit 70. The developing unit 60 includes a developing roller 61, a supply roller 62, and a toner chamber 63. The drum unit 70 includes the photosensitive drum 71, a charging roller 72, and a cleaner 73.

The drawer 80 supports the four process cartridges PC such that the process cartridges PC are detachable from and attachable to the drawer 80. The drawer 80 includes a main frame 81 for supporting the plurality of process cartridges PC, and a handle portion 82 protruding from a front wall of the main frame 81. The drawer 80 can be withdrawn from a first position inside the main casing 2 (i.e. a position illustrated in FIG. 1) to a second position outside the main casing 2 (i.e. a position illustrated in FIG. 2) through the opening 2A of the main casing 2.

As illustrated in FIG. 2, the main frame 81 has a pair of left and right side walls 81A, a plurality of (eight in the embodiment) first positioning protrusions 83 formed in a general rectangular prismatic shape, and a plurality of (eight in the embodiment) second positioning protrusions 84 formed in a general columnar shape. The first positioning protrusions 83 and the second positioning protrusions 84 protrude inward in a left-right direction from the side walls 81A. More specifically, four of the first positioning protrusions 83 and four of the second positioning protrusions 84 protrude rightward from the left side wall 81A while remaining four of the first positioning protrusions 83 and remaining four of the second positioning protrusions 84 protrude leftward from the right side wall 81A.

Returning to FIG. 1, the belt unit 9 is disposed below the four process cartridges PC. The belt unit 9 includes an intermediate transfer belt 91, a plurality of (four in the embodiment) primary transfer rollers 92, a secondary transfer roller 93, a drive roller 94, and a driven roller 95. The intermediate transfer belt 91 is an endless belt.

The intermediate transfer belt 91 is positioned in confrontation with the four photosensitive drums 71. The intermediate transfer belt 91 is circularly movable in a clockwise direction in FIG. 1 by the drive roller 94.

Each of the primary transfer rollers 92 is in contact with an inner peripheral surface of the intermediate transfer belt 91. Each primary transfer roller 92 nips the intermediate transfer belt 91 in cooperation with the corresponding photosensitive drum 71. The secondary transfer roller 93 nips the intermediate transfer belt 91 in cooperation with the drive roller 94.

The fixing device 10 is disposed above the secondary transfer roller 93. The fixing device 10 includes a heating roller 11 and a pressure roller 12.

In the image forming unit 4 configured as described above, initially, each charging roller 72 applies a charge to the surface of the corresponding photosensitive drum 71. The scanning unit 5 exposes the surface of each photosensitive drum 71, forming an electrostatic latent image on the surface of the photosensitive drum 71 based on image data.

Subsequently, each developing roller 61 supplies toner to the electrostatic latent image formed on the corresponding photosensitive drum 71. As a result, the photosensitive drum 71 carries a toner image on its surface.

The toner image formed on each photosensitive drum 71 is transferred onto the intermediate transfer belt 91 by the corresponding primary transfer roller 92 to which a transfer bias is applied. As the sheet P supplied to the image forming unit 4 passes between the intermediate transfer belt 91 and the secondary transfer roller 93, the toner image transferred onto the intermediate transfer belt 91 is transferred onto the sheet P by the secondary transfer roller 93 to which a transfer bias is applied.

The sheet P onto which the toner image is transferred is conveyed to the fixing device 10. The fixing device 10 thermally fixes the toner image to the sheet P. The sheet P to which the toner image is thermally fixed is discharged out of the main casing 2 by a discharge roller R and stacked on a discharge tray 22.

Next, a configuration of the process cartridge PC will be described in detail.

Figure 3:
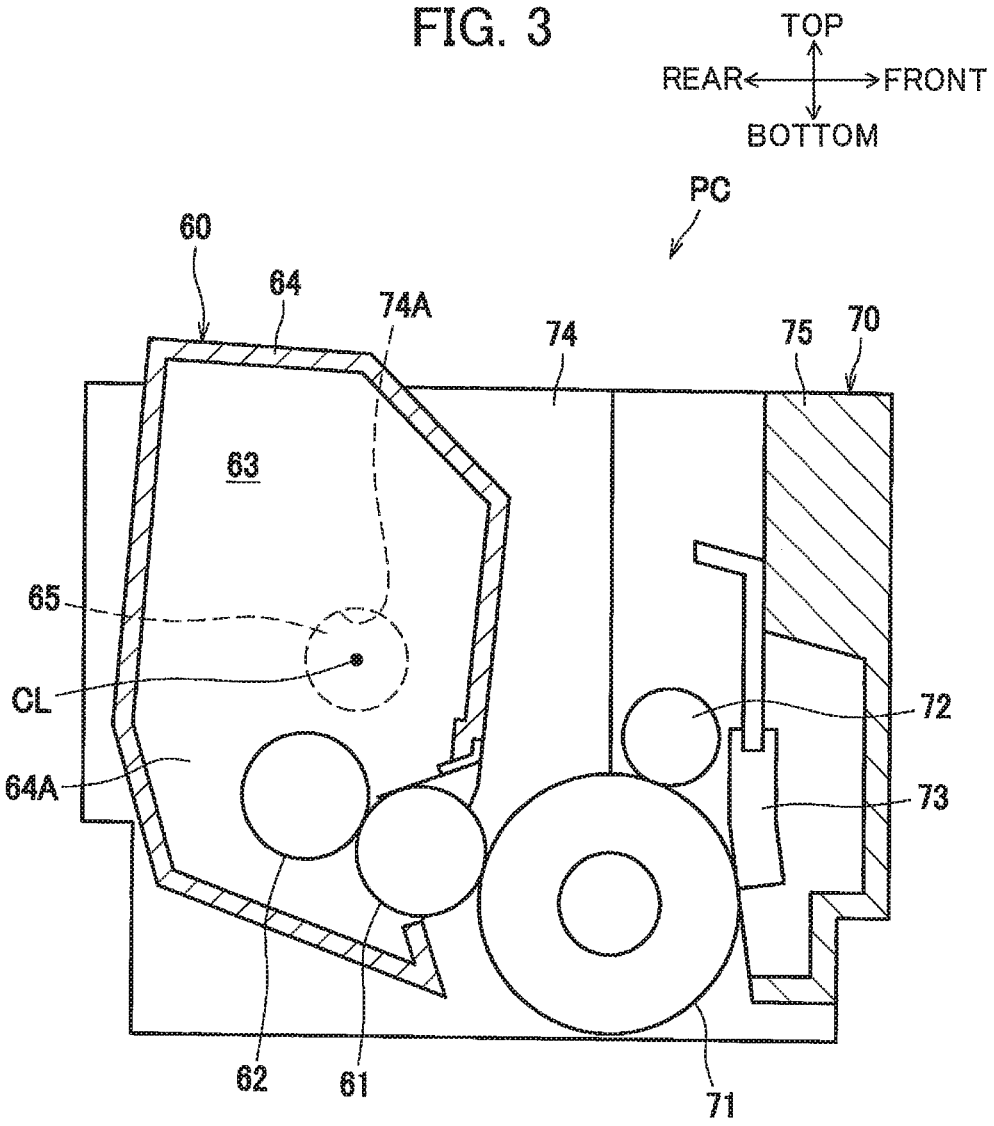
FIG. 3 is a schematic cross-sectional view of the process cartridge.

As illustrated in FIG. 3, the drum unit 70 further includes two side frames 74 (only one is illustrated) and a connecting frame 75 for connecting the side frames 74.

The side frames 74 are respectively disposed at axial end portions of the photosensitive drum 71. The side frames 74 rotatably support the photosensitive drum 71. Each of the side frames 74 has a support groove 74A for pivotally movably supporting the developing unit 60. The support groove 74A is formed in an inner surface of the side frame 74. More specifically, the support groove 74A is recessed outward in the left-right direction from the inner surface of the side frame 74.

The developing unit 60 is attached to the side frames 74 so as to be pivotally movable about a prescribed pivot axis CL. The developing unit 60 includes a casing 64 for accommodating toner therein. The casing 64 is positioned between the side frames 74. The casing 64 includes two side walls 64A (only one is illustrated) and two shaft portions 65. The two side walls 64A respectively constitute left and right walls of the casing 64. The shaft portions 65 are formed in a columnar shape. The shaft portions 65 protrude outward in an axial direction of the photosensitive drum 71 from the side walls 64A, respectively. The shaft portions 65 are rotatably supported in the support grooves 74A of the side frames 74, respectively. The shaft portions 65 are aligned in the axial direction, and the center of the shaft portions 65 serves as the pivot axis CL. The pivot axis CL extends linearly in the axial direction.

Hereinafter, an extending direction of the pivot axis CL will be referred to as a pivot axis direction. Further, a direction perpendicular to the pivot axis direction and in which the developing roller 61 confronts the photosensitive drums 71 will be referred to as a first perpendicular direction. Further, a direction perpendicular to the pivot axis direction and the first perpendicular direction will be referred to as a second perpendicular direction. The first perpendicular direction is coincident with a moving direction of the drawer 80.

Figure 4:
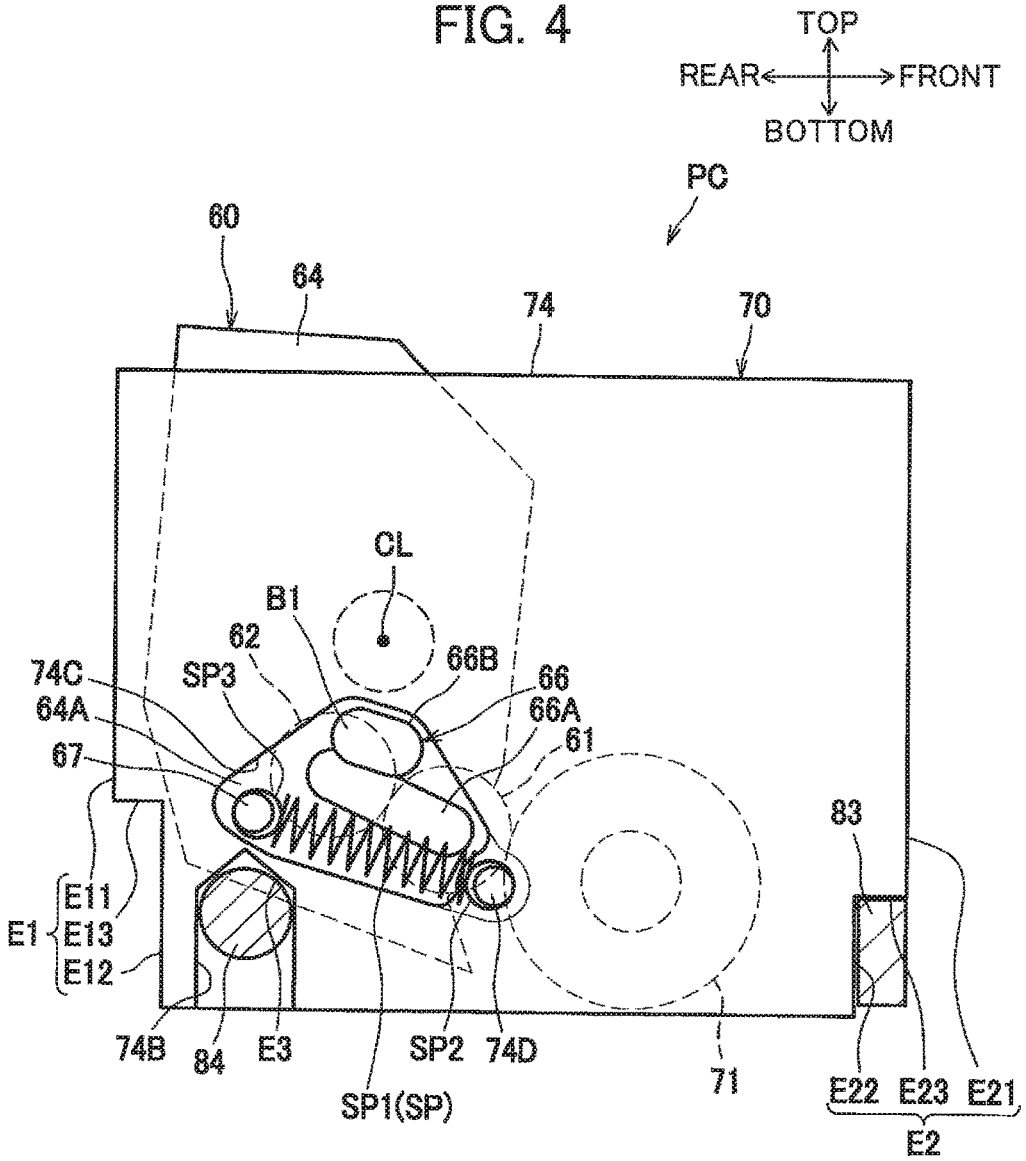
FIG. 4 is a schematic side view of the process cartridge as viewed in a pivot axis direction, in which a developing unit of the process cartridge is in a third position.
Figure 5:
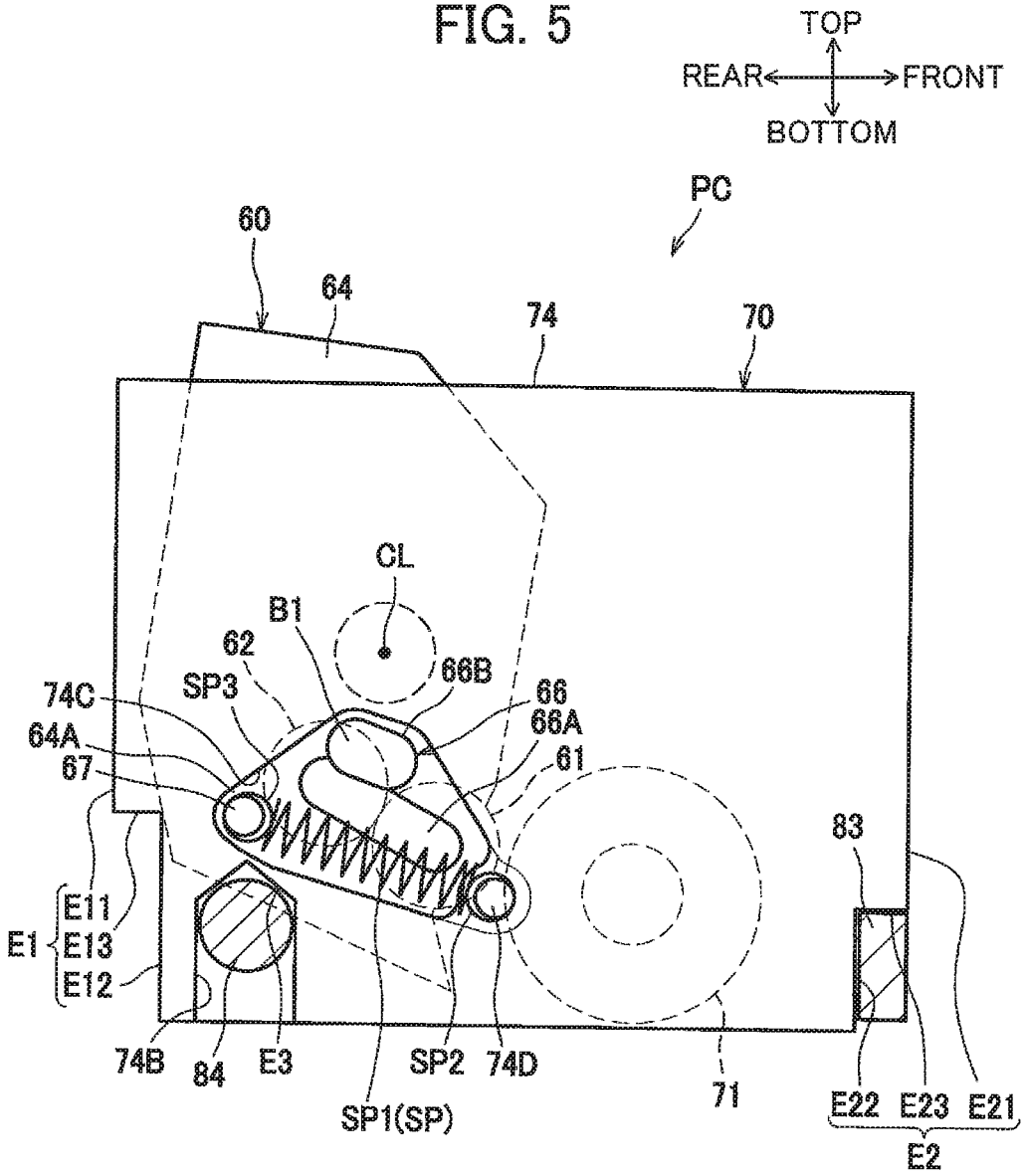
FIG. 5 is a schematic side view of the process cartridge as viewed in the pivot axis direction, in which the developing unit is in a fourth position.

The developing unit 60 is movable to a third position illustrated in FIG. 4 and to a fourth position illustrated in FIG. 5. In the third position, the developing roller 61 is in contact with the corresponding photosensitive drum 71. In the fourth position, the developing roller 61 is separated from the corresponding photosensitive drum 71, that is, the developing roller 61 is out of contact with the corresponding photosensitive drum 71.

Incidentally, in the non-contact development method, the developing roller 61 may be slightly separated from the corresponding photosensitive drum 71 when the developing unit 60 is in the third position. In this case, when the developing unit 60 is in the fourth position, the developing roller 61 is farther separated from the corresponding photosensitive drum 71 than the third position.

As illustrated in FIG. 4, the side frame 74 has a first end portion E1 constituting one end portion of the side frame 74 in the first perpendicular direction. That is, the first end portion E1 constitutes a rear end portion of the side frame 74. Further, the side frame 74 has a second end portion E2 constituting the other end portion of the side frame 74 in the first perpendicular direction. That is, the second end portion E2 constitutes a front end portion of the side frame 74.

The first end portion E1 and a rotation axis of the photosensitive drum 71 are disposed on opposite sides of a rotation axis of the developing roller 61 in the first perpendicular direction.

The first end portion E1 includes a first portion E11, a second portion E12, and a third portion E13.

The first portion E11 constitutes one end portion of the first end portion E1 in the second perpendicular direction and is positioned on one side of the first end portion E1 in the second perpendicular direction. That is, the first portion E11 constitutes an upper portion of the first end portion E1. The second portion E12 constitutes the other end portion of the first end portion E1 in the second perpendicular direction and is positioned on the other side relative to the first portion E11 in the second perpendicular direction. That is, the second portion E12 constitutes a lower portion of the first end portion E1 and is positioned below the first portion E11. Further, the second portion E12 is positioned closer to the second end portion E2 than the first portion E11 to the second end portion E2 in the first perpendicular direction. The third portion E13 connects the first portion E11 to the second portion E12.

The second end portion E2 and the rotation axis of the developing roller 61 are disposed on opposite sides of the rotation axis of the photosensitive drum 71 in the first perpendicular direction.

The second end portion E2 includes a fourth portion E21, a fifth portion E22, and a sixth portion E23.

The fourth portion E21 constitutes one end portion of the second end portion E2 in the second perpendicular direction and is positioned on one side of the second end portion E2 in the second perpendicular direction. That is, the fourth portion E21 constitutes an upper portion of the second end portion E2. The fifth portion E22 constitutes the other end portion of the second end portion E2 in the second perpendicular direction and is positioned on the other side relative to the fourth portion E21 in the second perpendicular direction. That is, the fifth portion E22 constitutes a lower portion of the second end portion E2 and is positioned below the fourth portion E21. Further, the fifth portion E22 is positioned closer to the first end portion E1 than the fourth portion E21 to the first end portion E1 in the first perpendicular direction. The sixth portion E23 connects the fourth portion E21 to the fifth portion E22.

The fifth portion E22 serves as a positioning surface for positioning the side frame 74 relative to the drawer 80 in the first perpendicular direction when contacting the first positioning protrusion 83 of the drawer 80. The sixth portion E23 also serves as a positioning surface for positioning the side frame 74 relative to the drawer 80 in the second perpendicular direction when contacting the first positioning protrusion 83 of the drawer 80.

The side frame 74 also has a positioning groove 74B engageable with the second positioning protrusion 84 of the drawer 80. The positioning groove 74B is open on an outer side thereof in the pivot axis direction and the other side thereof in the second perpendicular direction. In other words, the positioning groove 74B has an opening facing outward in the left-right direction and downward. The positioning groove 74B has an end portion E3 defining one end of the positioning groove 74B in the second perpendicular direction and positioned on one side of the positioning groove 74B in the second perpendicular direction. That is, the end portion E3 constitutes an upper end portion of the positioning groove 74B. The end portion E3 is formed in a general V-shape in cross-section.

The V-shaped end portion E3 of the positioning groove 74B engages with the second positioning protrusion 84, and the fifth portion E22 and the sixth portion E23 engage with the first positioning protrusion 83, thereby positioning the side frame 74 relative to the drawer 80 in the first perpendicular direction and the second perpendicular direction.

Note that the first end portion E1, the second end portion E2, and the positioning groove 74B is provided at least one of the two side frames 74. That is, the first end portion E1, the second end portion E2, and the positioning groove 74B may be provided at only one of the two side frames 74. Alternatively, the first end portion E1, the second end portion E2, and the positioning groove 74B may be provided at both of the two side frames 74.

One of the two side frames 74 has a through-hole 74C penetrating the side frame 74 in the pivot axis direction, and a first attachment pin 74D to which a first attachment portion SP2 of a tension coil spring SP (described later) as an example of an urging member is attached. The through-hole 74C is positioned between the pivot axis CL and the positioning groove 74B. The first attachment pin 74D is positioned between the through-hole 74C and the rotation axis of the photosensitive drum 71. The first attachment pin 74D protrudes from an outer surface of the side frame 74 in the pivot axis direction. In other words, the first attachment pin 74D protrudes outward in the left-right direction from an outer left-right surface of the side frame 74.

The developing unit 60 further includes an electrically-conductive member 66 for applying voltage to the developing roller 61 and the supply roller 62, and a second attachment pin 67 to which a second attachment portion SP3 of the tension coil spring SP is attached. The electrically-conductive member 66 and the second attachment pin 67 are positioned on one side of the casing 64 in the pivot axis direction. More specifically, the electrically-conductive member 66 and the second attachment pin 67 are provided at a left-right outer surface of one of the side walls 64A. The electrically-conductive member 66 and the second attachment pin 67 are exposed to an outside through the through-hole 74C formed in the side frame 74.

The electrically-conductive member 66 is made of an electrically-conductive resin. The electrically-conductive member 66 includes a shaft support portion 66A and a contact portion 66B. The shaft support portion 66A rotatably supports a metal shaft of the developing roller 61 and a metal shaft of the supply roller 62. That is, the shaft support portion 66A is in contact with the shaft of the developing roller 61 and the shaft of the supply roller 62. The shaft support portion 66A is fixed to the casing 64 by insert molding, for example. Incidentally, the casing 64 is made of a non-electric ally conductive resin.

The contact portion 66B is an electrode capable of contacting a main-casing-side electrode (not illustrated) provided in the main casing 2. The main-casing-side electrode serves as an electric contact. The contact portion 66B has a perpendicular surface B1 perpendicular to the pivot axis direction. The perpendicular surface B1 is exposed to the outside through the through-hole 74C. Further, the side wall 81A of the drawer 80 has an opening or slit (not illustrated) through which the contact portion 66B is exposed to an outside for contacting the main casing-side electrode. The contact portion 66B is positioned between the pivot axis CL and the tension coil spring SP when viewed in the pivot axis direction.

The contact portion 66B has a general oval shape elongated in a pivoting direction of the developing unit 60. More specifically, the contact portion 66B has an outer circumferential shape formed by two straight lines extending parallel to each other, a semi-circle connecting one ends of the two straight lines, and a semi-circle connecting the other ends of the two straight lines. Note that the length of the contact portion 66B in the pivoting direction, i.e., the length of the contact portion 66B in the elongated direction, may be equal to or greater than 5 mm and equal to or smaller than 12 mm. Alternatively, the length of the contact portion 66B in the pivoting direction (elongated direction) may be equal to or greater than 6 mm and equal to or smaller than 10 mm. Still alternatively, the length of the contact portion 66B in the pivoting direction (elongated direction) may be equal to or greater than 7 mm and equal to or smaller than 9 mm.

Each of the process cartridges PC includes the tension coil spring SP for urging the developing roller 61 toward the corresponding photosensitive drum 71. The tension coil spring SP includes a coil portion SP1, the first attachment portion SP2, and the second attachment portion SP3. The first attachment portion SP2 and the second attachment portion SP3 have a ring shape. The length of the coil portion SP1 is greater than the length of the contact portion 66B in the elongated direction. The first attachment portion SP2 is connected to one end portion of the coil portion SP1, while the second attachment portion SP3 is connected to the other end portion of the coil portion SP1.

Next, layout of parts and components of the process cartridge PC will be described in detail with reference to FIG. 6.

Figure 6:
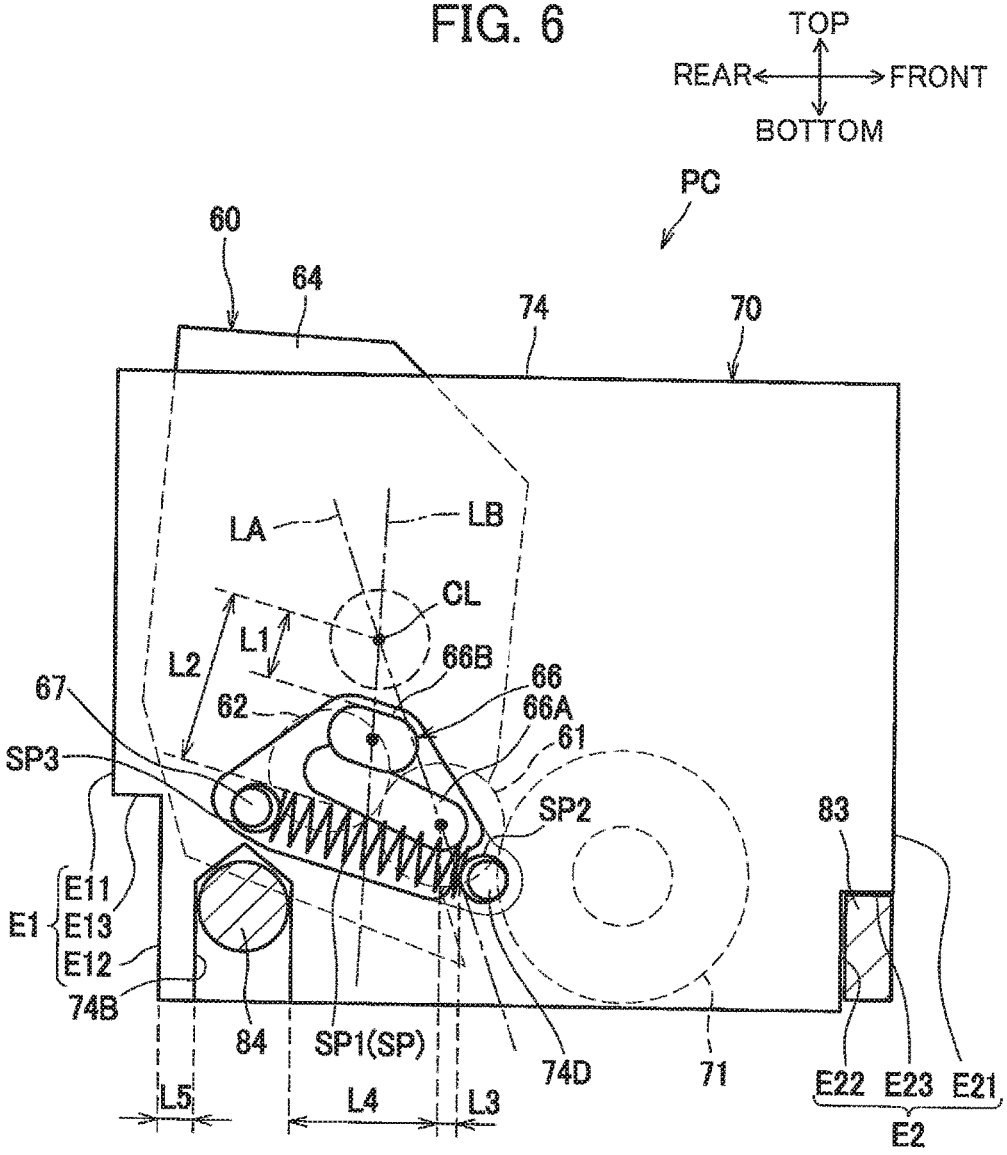
FIG. 6 is an explanatory view of the process cartridge for illustrating parts and components of the process cartridge and positional relationship therebetween.

As illustrated in FIG. 6, a distance L1 (shortest distance) from the pivot axis CL to the contact portion 66B is smaller than a distance L2 (shortest distance) from the pivot axis CL to the tension coil spring SP. Note that the distance L1 from the pivot axis CL to the contact portion 66B may be equal to or greater than 7 mm and equal to or smaller than 12 mm. Alternatively, the distance L1 from the pivot axis CL to the contact portion 66B may be equal to or greater than 8 mm and equal to or smaller than 11 mm.

The tension coil spring SP extends so as to cross a straight line LA passing the rotation axis of the developing roller 61 and the pivot axis CL when viewed in the pivot axis direction. A distance L3 from the first attachment portion SP2 constituting one end portion of the tension coil spring SP to the rotation axis of the developing roller 61 is smaller than a distance L4 from the rotation axis of the developing roller 61 to the positioning groove 74B.

A distance L5 from the first end portion E1 of the side frame 74 to the positioning groove 74B is smaller than the distance L4 from the rotation axis of the developing roller 61 to the positioning groove 74B. The positioning groove 74B and the photosensitive drum 71 are disposed on opposite sides of a straight line LB passing the center (centroid) of the contact portion 66B and the pivot axis CL when viewed in the pivot axis direction.

Next, operations of parts and components of the process cartridge PC and the drawer 80 when the process cartridge PC is attached to the drawer 80 and when an image-forming operation is performed will be described.

When the process cartridge PC is attached to the drawer 80 as illustrated in FIG. 2, the second end portion E2 (the fifth portion E22 and the sixth portion E23) of the side frame 74 is engaged with the first positioning protrusion 83 of the drawer 80, and the positioning groove 74B of the side frame 74 is engaged with the second positioning protrusion 84 of the drawer 80 as illustrated in FIG. 4. The positioning groove 74B is formed in the side frame 74 at a position adjacent to the first end portion E1 positioned opposite to the second end portion E2 with respect to the positioning groove 74B in the first perpendicular direction. Thus, a distance from the positioning groove 74B to the second end portion E2 becomes greater than a distance from the positioning groove 74B to the first end portion E1. Compared to a case where the distance from the positioning groove 74B to the second end portion E2 is small, this configuration can reliably enhance positioning of the process cartridges PC relative to the drawer 80.

When a monochromatic image-forming operation is performed, the developing unit 60 in which black toner is accommodated is placed on the third position illustrated in FIG. 4. At this time, the contact portion 66B is in contact with the main-casing-side electrode (not illustrated). When voltage is applied to the developing roller 61 and the supply roller 62, toner carried on the supply roller 62 can be reliably supplied to the developing roller 61. Further, toner carried on the developing roller 61 can be reliably supplied to an electrostatic latent image formed on the photosensitive drum 71.

Further, when the monochromatic image-forming operation is performed, the developing unit 60 in which non-black toner is accommodated is placed on the fourth position illustrated in FIG. 5. At this time, the contact portion 66B is disposed at a position farther separated from the corresponding photosensitive drum 71 than the position in FIG. 4. Note that, even in the fourth position, the contact portion 66B is in contact with the main-casing-side electrode. Hence, compared with a case where the main-casing-side electrode separates from the contact portion 66B every time the developing roller 61 separates from the corresponding photosensitive drum 71, configuration of the main casing 2 can be simplified. Further, in the embodiment, the main-casing-side electrode is in contact with the contact portion 66B when the developing unit 60 is in the third position and in the fourth position. Therefore, this configuration can prevent the main-casing-side electrode from getting caught on components of the process cartridge PC provided at a side surface thereof.

According to the above embodiment, the process cartridge PC provides the following operational advantages.

The distance L1 from the contact portion 66B to the pivot axis CL is smaller than the distance L2 from the pivot axis CL to the tension coil spring SP. Thus, a moving range of the contact portion 66B in accordance with the pivotal movement of the developing unit 60 can be minimized. Accordingly, the size of the contact portion 66B in the elongated direction, i.e. the size taken into account the relationship with the main-casing-side electrode that contacts the contact portion 66B, can be made smaller.

When viewed in the pivot axis direction, the contact portion 66B is disposed between the pivot axis CL and the tension coil spring SP. Thus, without complicating the configuration of the process cartridge PC, the tension coil spring SP and the contact portion 66B can be disposed.

The distance L5 from the first end portion E1 of the side frame 74 to the positioning groove 74B is smaller than the distance L4 from the positioning groove 74B to the rotation axis of the developing roller 61. This configuration allows the positioning groove 74B to be positioned adjacent to the first end portion E1. As a result, the positioning groove 74B positioned adjacent to the first end portion E1 can be easily engaged with the second positioning protrusion 84. Accordingly, an operation for positioning the process cartridge PC relative to the drawer 80 can be easily performed.

A distance from the positioning groove 74B disposed adjacent to the first end portion E1 to the fifth portion E22 and the sixth portion E23 serving as positioning surfaces can be made greater. Therefore, precise positioning of the process cartridge PC relative to the drawer 80 can be achieved.

Various modifications to the above embodiment are conceivable.

In the embodiment, the tension coil spring SP is exemplified as an urging member. However, a torsion spring, a leaf spring, and a compression coil spring may be available for the urging member.

In the embodiment, the color printer 1 is exemplified as an image forming apparatus. However, a copying machine and a multi-function peripheral may be available for the image forming apparatus.

While the description has been made in detail with reference to the embodiments thereof, it would be apparent to those skilled in the art that many modifications and variations may be made therein without departing from the scope of the disclosure.

What is claimed is:

1. A process cartridge comprising:

a developing unit including a developing roller rotatable about a rotation axis extending in an extending direction;

a drum unit including a photosensitive drum, the developing unit being pivotally movable relative to the drum unit about a pivot axis extending in the extending direction; and an urging member configured to urge the developing roller toward the photosensitive drum, wherein the developing unit further includes:

an electrically-conductive member configured to apply voltage to the developing roller, the electrically-conductive member being made of an electrically-conductive resin, the electrically-conductive member including a contact portion configured to contact an electric contact of an image forming apparatus, and wherein a first distance between the pivot axis and the contact portion is smaller than a second distance between the pivot axis and the urging member.

2. The process cartridge according to claim 1, wherein the contact portion is positioned between the pivot axis and the urging member as viewed in the extending direction.

3. The process cartridge according to claim 1, wherein the developing unit is pivotally movable relative to the drum unit in a pivoting direction, wherein the contact portion has a length in the pivoting direction, and wherein the urging member comprises a coil spring having a coil portion, the coil portion having a length greater than the length of the contact portion.

4. The process cartridge according to claim 3, wherein the length of the contact portion in the pivoting direction is in a range from 5 mm to 12 mm.

5. The process cartridge according to claim 4, wherein the length of the contact portion in the pivoting direction is in a range from 6 mm to 10 mm.

6. The process cartridge according to claim 5, wherein the length of the contact portion in the pivoting direction is in a range from 7 mm to 9 mm.

7. The process cartridge according to claim 1, wherein the pivot axis extends in a pivot axis direction, and wherein the urging member extends so as to cross a straight line passing the rotation axis of the developing roller and the pivot axis when viewed in the extending direction.

8. The process cartridge according to claim 1, wherein the urging member has one end portion attached to the drum unit and another end portion attached to the developing unit.

9. The process cartridge according to claim 8, wherein the drum unit has a positioning groove engageable with a positioning protrusion of a drawer configured to be withdrawn from a first position inside a main casing of the image forming apparatus to a second position outside the main casing.

10. The process cartridge according to claim 9, wherein the drum unit includes a pair of side frames rotatably supporting the photosensitive drum, the pair of side frames further pivotally and movably supporting the developing unit, wherein at least one of the pair of side frames has a first end portion and a second end portion, the first end portion and a rotation axis of the photosensitive drum being disposed on opposite sides of the rotation axis of the developing roller, the second end portion and the rotation axis of the developing roller being disposed on opposite sides of the rotation axis of the photosensitive drum, and wherein a distance from the first end portion to the positioning groove is smaller than a distance from the positioning groove to the rotation axis of the developing roller.

11. The process cartridge according to claim 10, wherein the second end portion has a positioning surface for positioning the at least one of the pair of side frames relative to the drawer upon contact with the drawer.

12. The process cartridge according to claim 9, wherein a distance from the one end portion of the urging member to a rotation axis of the developing roller is smaller than the distance from the positioning groove to the rotation axis of the developing roller.

13. The process cartridge according to claim 9, wherein the positioning groove and the photosensitive drum are disposed on opposite sides of a straight line passing a center of the contact portion and the pivot axis.

14. The process cartridge according to claim 1, wherein the pivot axis extends in a pivot axis direction, and wherein the contact portion has a perpendicular surface perpendicular to the pivot axis direction, the perpendicular surface being exposed to an outside.

15. The process cartridge according to claim 1, wherein the developing unit further includes a supply roller configured to supply developer to the developing roller, and wherein the electrically-conductive member is in contact with the supply roller.

16. The process cartridge according to claim 1, wherein the first distance is in a range from 7 mm to 12 mm.

17. The process cartridge according to claim 16, wherein the first distance is in a range from 8 mm to 11 mm.

18. The process cartridge according to claim 1, wherein the developing unit further includes:

a casing configured to accommodate toner therein, and wherein the electrically-conductive member is positioned at one side of the casing in the extending direction.

* * * * *